United States Patent [19]

Watson et al.

[11] Patent Number: 5,007,639

[45] Date of Patent: Apr. 16, 1991

[54] GAME BALL

[75] Inventors: Dean R. Watson, Algonquin, Ill.; Thomas E. Gallagher, IV, Colorado Springs, Colo.

[73] Assignee: T. G. & Watson, Inc., Algonquin, Ill.

[21] Appl. No.: 580,084

[22] Filed: Sep. 10, 1990

[51] Int. Cl.[5] ..... A63B 37/06; A63B 37/12

[52] U.S. Cl. ..... 273/60 R; 273/65 EG; 273/DIG. 20; 273/58 K

[58] Field of Search ..... 273/60 R, 60 A, 60 B, 273/DIG. 20, 65 EG, 65 ED, 58 A, 58 K, 428

[56] References Cited

U.S. PATENT DOCUMENTS

| | | | |
|---|---|---|---|
| 860,589 | 7/1907 | Wharton | 273/65 EG |
| 2,399,324 | 4/1946 | Clark | 273/60 R |
| 3,256,019 | 6/1966 | Barton | 273/60 R |
| 4,211,407 | 7/1980 | Tomar | 273/60 B |
| 4,354,679 | 10/1982 | Steinmetz | 273/58 A |

*Primary Examiner*—George J. Marlo

*Attorney, Agent, or Firm*—Douglas B. White

[57] ABSTRACT

Generally there is described herein a game ball having a core, a plurality of layers of plastic bubble film, a layer of yarn and finally a cover. The result is a soft, lightweight "safe" ball, which feels and handles like a baseball.

7 Claims, 1 Drawing Sheet

GAME BALL

BACKGROUND OF THE INVENTION

1. Field of the Invention

This invention relates generally to balls used in games such as baseball, softball, or the like. More particularly, this invention relates to an improvement in such balls which decreases the weight and hardness of the ball yet maintains good baseball-like performance characteristics.

2. Description of the Prior Art

Baseballs and softballs have been known for their injury and damage potential, and this is attributed mainly to their weight and hardness. While this characteristic of the balls has long been recognized, a satisfactory alternative "safe" ball has not previously been presented.

In U.S. Pat. No. 4,462,589 a design for such a soft baseball is presented. A soft foam sphere is covered with a nylon outer layer to achieve a light and spongy ball. While this approach produces a yielding and forgiving ball, the baseball characteristics relating to performance, handling and feel have been sacrificed.

A more rigid version of a safe ball is presented in U.S. Pat. No. 3,069,170 where a structure of expanded polyethylene is formed and smoothed. This design achieves extraordinary lightness and durability, but the feel of the ball and any performance comparable to a baseball is again totally lost.

SUMMARY OF THE INVENTION

The present invention is designed to achieve the best baseball performance characteristics possible while reducing the injury and property damage potential. Generally there is provided a core, a plurality of layers of plastic bubble film, a layer of yarn and finally a baseball-like cover. The result is a soft, lightweight ball, but one which still feels and handles like a baseball. Moreover, the resiliency has been found to be well balanced to the size and weight of the ball to produce a remarkable baseball-like performance.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
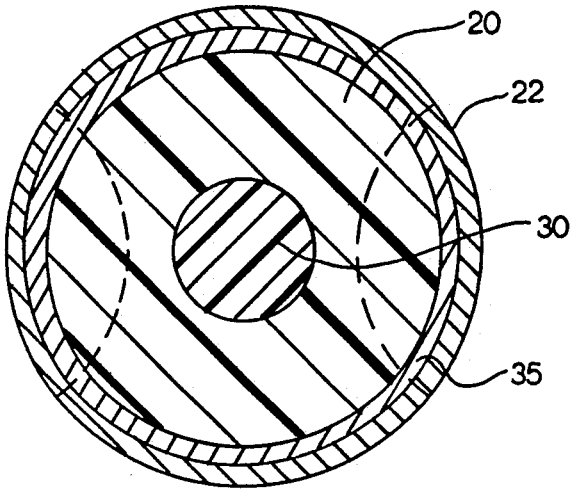
FIG. 1 is a cross sectional view of the ball construction of the present invention.
Figure 2:
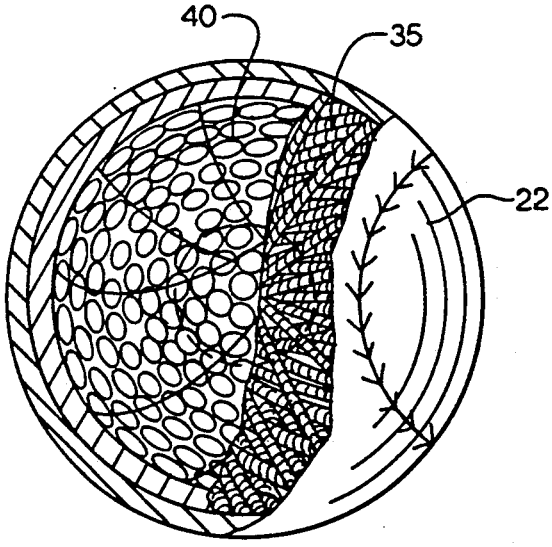
FIG. 2 is a partially cutaway view of the ball construction of the present invention.
Figure 3:
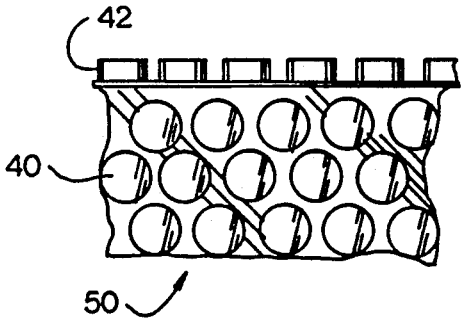
FIG. 3 is a top and edge view of a sheet of the plastic bubble component of the ball construction.

Turning now to the drawings, there is shown in FIGS. 1 and 2 the ball construction in accordance with the present invention. Essentially, the ball contains predominantly a volume of plastic encased air bubbles 40 filling the interior of the ball and a cover 22 surrounding the exterior. To assist in the manufacturing, and to control the weight of the ball, a core 30 may be used at the center. Additionally, surrounding the plastic encased bubbles a layer of string or yarn 35 may be used to "even out" the bubble layer and thereby improve the roundness.

The plastic encased bubbles 40 are preferably formed of a polyethylene film enclosing air or other gas. The walls 42 of the bubbles are thin enough to yield and to provide a spring effect when the bubbles are compressed. In the present embodiment, these bubbles are formed as sheets 50 of material known generically as bubble film or bubble wrap and sold under numerous trademarks, such as AirCap or PolyCap. In manufacturing, these sheets are reduced to narrow strips, approximately two inches wide, and wrapped around the core, if any, to build a spherical volume and form a ball. Since the overlapping sheets of bubble film tends to leave an uneven surface, the layer of yarn or string 35 is wrapped over the bubble layer. This evens-out the surface and helps unify the bubble layers. Lastly, an outer cover 22 resembling the texture and feel of a conventional baseball is sewn on the exterior to complete the ball.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A game ball for use in playing such games as baseball, softball or the like comprising:

a plurality of film encased bubbles arranged to form a substantially spherical object; and an outer covering surrounding said bubbles.

2. The game ball of claim 1 wherein said bubbles are arranged on sheets of plastic bubble film and wrapped into a plurality of layers to form said spherical object.

3. The game ball of claim 2 wherein said sheets of plastic bubble film are comprised of narrow strips thereof.

4. The game ball of claim 3 further comprising a core, and wherein said strips of plastic bubble film are wrapped around said core.

5. The game ball of claim 4 further comprising a layer of string material intermediate said bubble layer and said outer covering.

6. The game ball of claim 5 wherein said outer covering closely resembles the cover of a baseball.

7. The game ball of claim 1 further comprising a layer of string material intermediate said bubble layer and said outer covering.

* * * * *